United States Patent [19]

Vidovic

[11] Patent Number: 5,017,036

[45] Date of Patent: May 21, 1991

[54] TOOTHBRUSH WITH ABSORBENT PAD

[76] Inventor: Gerda Vidovic, 446-3rd Street, South, Kenora, Ontario, Canada, P9N 1J1

[21] Appl. No.: 418,844

[22] Filed: Oct. 10, 1989

Related U.S. Application Data

[62] Division of Ser. No. 108,050, Oct. 13, 1987, Pat. No. 4,886,389.

[51] Int. Cl.[5] ..... A46B 11/04

[52] U.S. Cl. ..... 401/283; 401/269; 401/270; 401/279

[58] Field of Search ..... 401/283, 270, 279, 280, 401/269

[56] References Cited

U.S. PATENT DOCUMENTS 2,652,949 9/1953 Martin ..... 401/279 X 3,903,888 9/1975 Buelow et al. ..... 401/270 X 4,615,635 10/1986 Kim ..... 401/269 X

FOREIGN PATENT DOCUMENTS 445118 11/1912 France ..... 401/270

1494879 9/1967 France ..... 401/283

*Primary Examiner*—Steven A. Bratlie

*Attorney, Agent, or Firm*—Irell & Manella

[57] ABSTRACT

A pocket or purse toothbrush has a reservoir of liquid dentifrice in the handle of the brush. The brush per se has an absorbent pad extending along the back, from a position near the reservoir to adjacent the brush bristles. A valve between the reservoir and the absorbent pad may be opened to saturate the pad with dentifrice, allowing tooth brushing without a supply of water and, if desired, in private even if away from home.

3 Claims, 8 Drawing Sheets

SECTION IV-IV

TOOTHBRUSH WITH ABSORBENT PAD

CROSS REFERENCE TO RELATED APPLICATION

This application is a division of application Ser. No. 108,050, filed Oct. 13, 1987 now U.S. Pat. No. 4,886,389.

FIELD OF THE INVENTION

The present invention relates to toothbrushes and more particularly to toothbrushes suitable to be carried in a pocket or purse.

BACKGROUND

For many people it would be convenient to have readily available in a pocket or purse a toothbrush that could be used to freshen the mouth when away from home, for example after dining out or smoking. While pocket and purse type toothbrushes are known, their use requires a separate supply of water and usually a separate supply of dentifrice. While some toothbrushes do carry their own dentifrice supply, they do require a water supply and are either difficult to handle after use or are single use, disposable brushes. The requirement for a water supply with any of these brushes is often inconvenient and can cause significant discomfiture for denture wearers who are often reluctant to clean their dentures in a public washroom.

SUMMARY

According to the present invention there is provided a toothbrush comprising a container, a reservoir in said container, a liquid dentifrice in said reservoir, a toothbrush normally housed within the container, said brush having a brushback, a liquid absorbent pad on one side of the back and bristles projecting from said one side of the back adjacent at least part of the pad, fluid passage means leading from the reservoir to a position adjacent the absorbent pad, and valve means in said fluid passage means, normally closing said fluid passage means and selectively operable to open the fluid passage means to allow liquid dentifrice to run from the reservoir into the absorbent pad.

The use of a liquid dentifrice rather than a paste allows the user to cleanse the teeth or dentures in private, without the need for a water supply. The absorbent material ensures that the liquid is retained adequately in the brush rather than running off prematurely. Once the brush has been used, the container can be closed to house the brush securely while it is deposited in a pocket or purse.

Embodiments of the invention may be constructed with the overall appearance of a pen, a lipstick container, a pocket lighter or other article that is normally carried in a pocket or purse, thus rendering the toothbrush an inobtrusive and possibly attractive accessory.

BRIEF DESCRIPTION OF THE DRAWINGS

In the accompanying drawings, which illustrate exemplary embodiments of the present invention.

DETAILED DESCRIPTION

Figure 1:
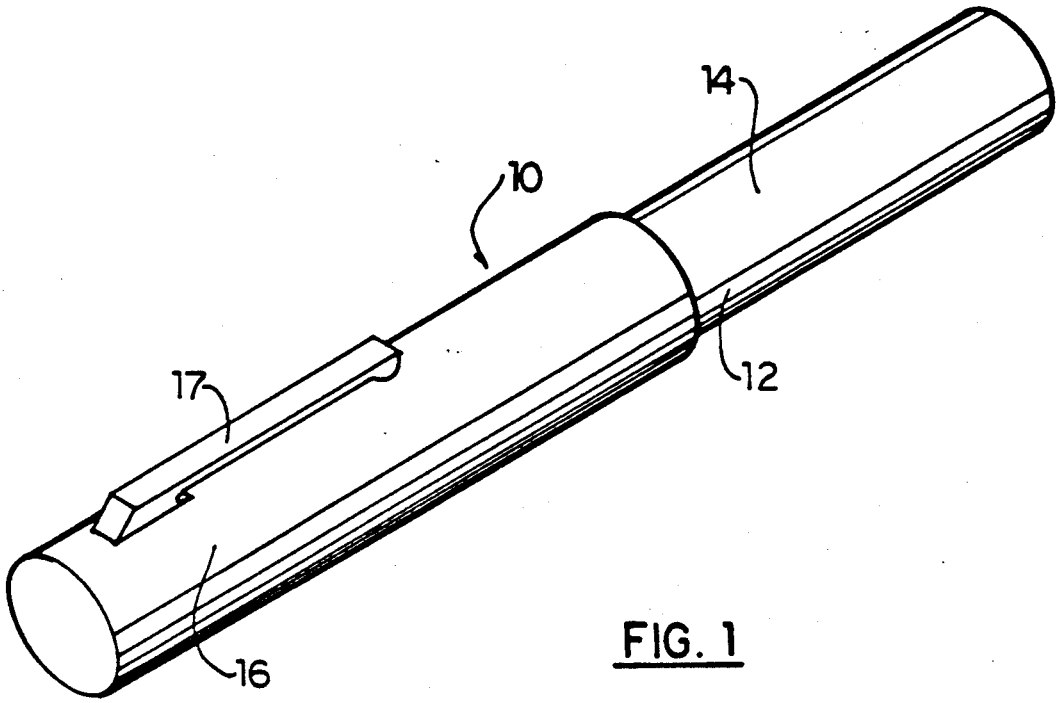
FIG. 1 is a perspective view of one embodiment of the invention in a closed condition.

Referring to the drawings, FIGS. 1 through 4 illustrate a toothbrush 10 that is constructed to have the overall general appearance of a pen or the like device that may be carried in a pocket. The brush 10 is housed in a container 12 that consists of a cylindrical barrel 14 and a cylindrical cap 16 fitted over the end of the barrel and held in place by threads 15. A clip 17 is fitted to the cap so that it can be carried in a pocket much in the manner of the conventional pen.

Figure 2:
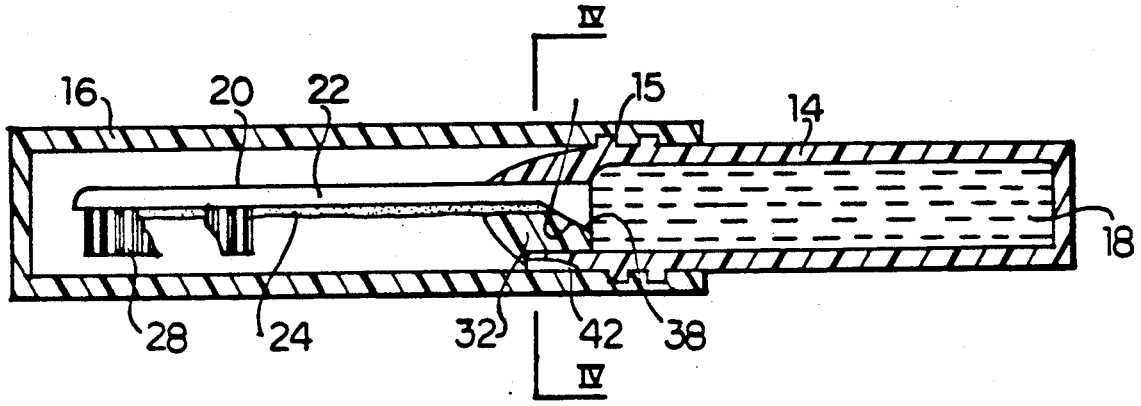
FIG. 2 is a longitudinal cross-section of the embodiment of FIG. 1.
Figure 3:
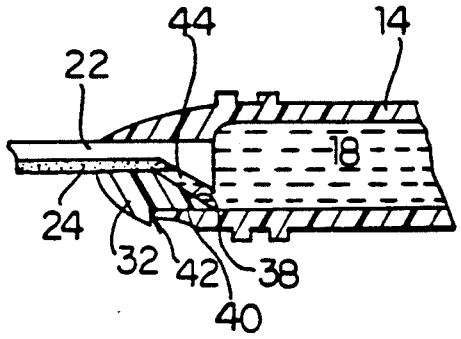
FIG. 3 is a partial cross-section of the embodiment of FIG. 1 showing the valve open.

As shown most particularly in FIGS. 2 and 3, the barrel 14 houses a reservoir 18 for liquid dentifrice 19. A brush 20 projects from the end of the barrel 14 that fits into the cap 16. The brush 20 has a brush back 22 carrying an absorbent pad 24 of foam rubber material. The pad extends most of the length of the brush back and is seated in a central groove 26 as most clearly illustrated in FIG. 4. The bristles 28 are fitted to the free end of the brush back 22 adjacent to the absorbent pad 24.

Figure 4:
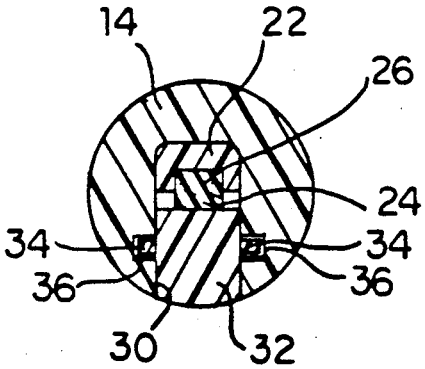
FIG. 4 is a cross-section along line IV—IV of FIG. 3.
Figure 5:
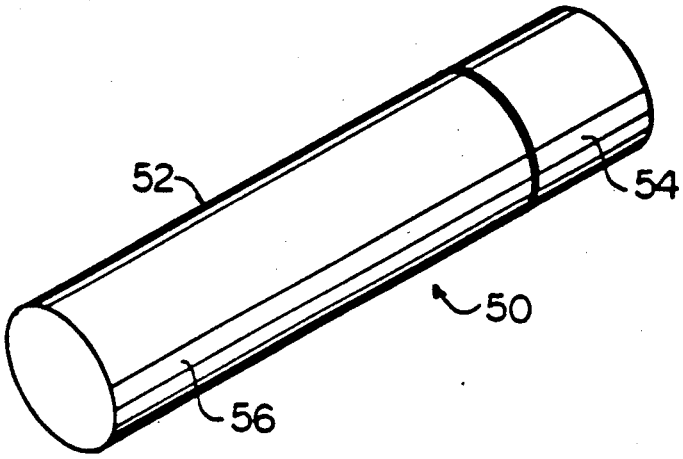
FIG. 5 is a perspective view of another embodiment of the invention.
Figure 6:
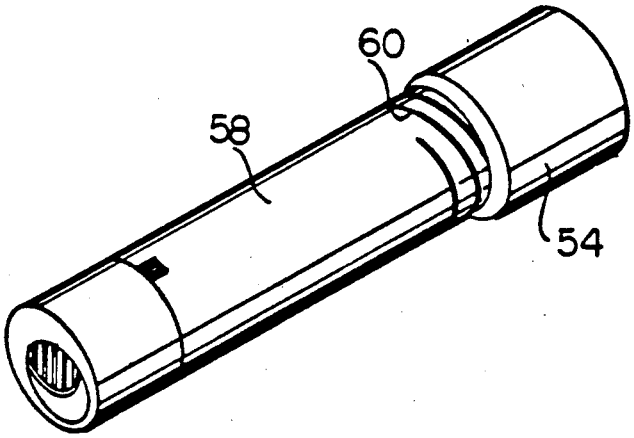
FIG. 6 is a perspective view of the embodiment of FIG. 5 with the cap removed.
Figure 7:
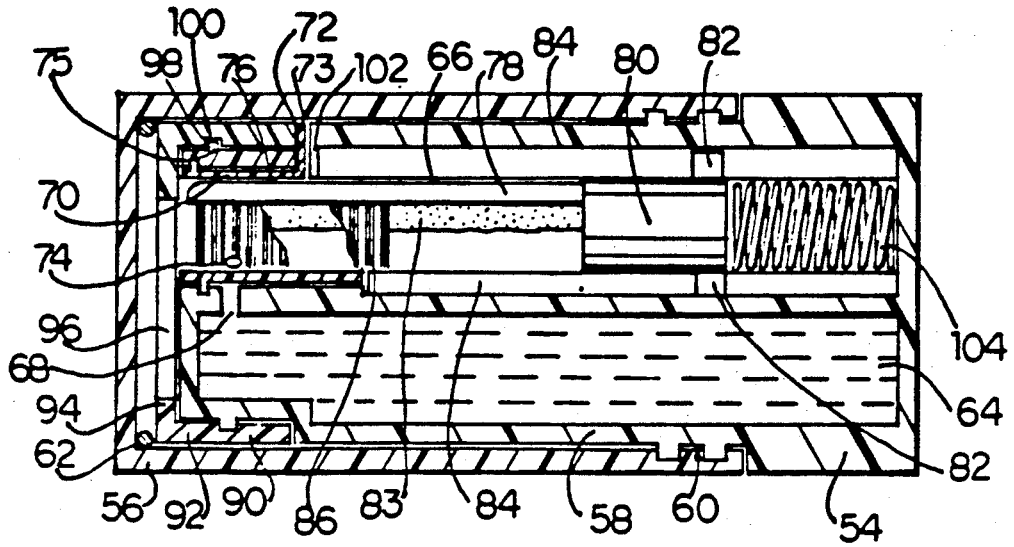
FIG. 7 is a longitudinal cross-section of the embodiment of FIG. 5.
Figure 8:
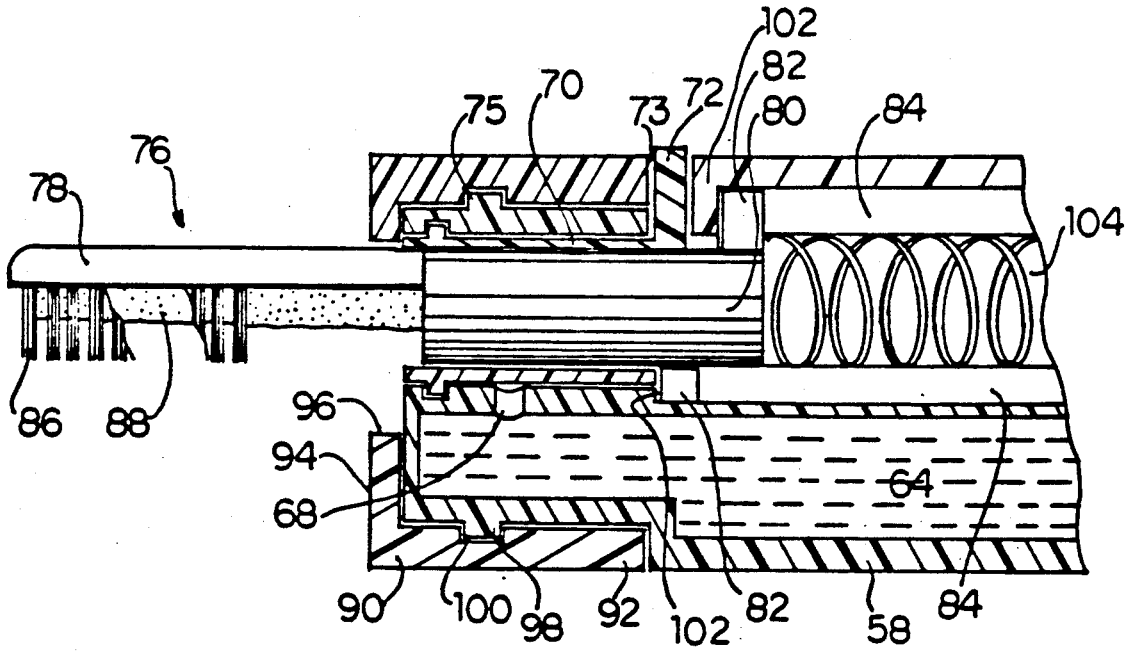
FIG. 8 is a longitudinal cross-section of the embodiment of FIG. 5 with the cap off and the brush extended.
Figure 9:
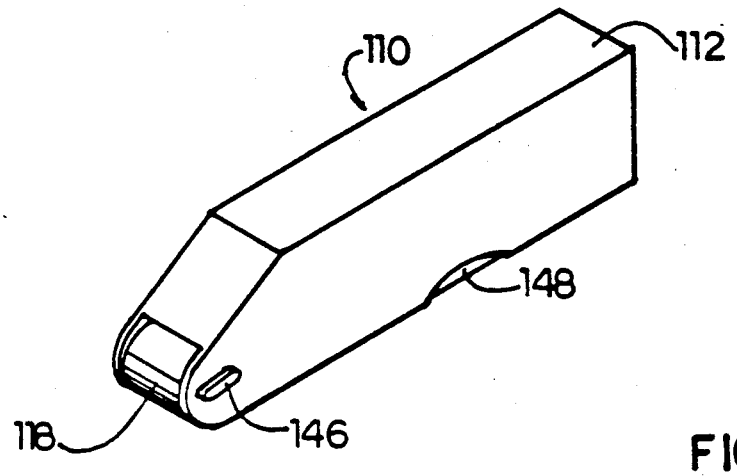
FIG. 9 is a perspective view of another embodiment of the present invention.

Adjacent to the end of the absorbent pad 24, the end of the barrel 14 has a groove 30 that accommodates a sliding valve element 32. As illustrated in FIG. 4, the valve element 32 has pins 34 projecting from its opposite sides to seat in guides 36 in the barrel 14. The valve element 32 has a sloping sealing face 38 that, in the closed position, engages a matching sealing face 40 on the end of the brush back. The barrel is relieved to provide a thumb catch 42 so that the valve element can be engaged by the thumb or the finger of the user to move the valve element from the closed condition illustrated in FIG. 2 to the open condition illustrated in FIG. 3. In the open condition, there is a fluid passage 44 formed between the sealing faces 38 and 40 of the valve element and the brush back leading from the reservoir 18 to the pad of absorbent material 24. This allows liquid dentifrice to saturate the pad 24 down to the bristles so that the brush can be used without wetting from a separate water supply.

Referring to FIGS. 5 through 8, there is illustrated another toothbrush embodiment 50 constructed to have the over general appearance of a tube of lipstick. The brush 50 is housed within a container 52 with a relatively short cylindrical base 54 and an elongated cylindrical cap 56. The base 54 is integral with an elongated barrel 58 that is screwed into the inside of the cap 56 by means of threads 60. An O-ring seal 62 is seated in the cap 56 to seal against the end of the barrel.

Within the barrel and extending from end to end therein is a reservoir 64 for liquid dentifrice and a brush chamber 66. The brush chamber 66 is cylindrical and projects from the side wall of the barrel into the reservoir 64. A port 68 adjacent to the cap end of the barrel leads from the reservoir to the brush chamber 66. It is normally closed by a cylindrical valve element 70 seated within the end of the brush chamber. A valve operator 72 projects radially from the valve element 70 through a circumferential slot 73 in the barrel so that the valve element may be rotated between a valve closed condition with a port 74 in the wall of the valve element out of line with the port 68 between the reservoir and the brush chamber and a valve open condition where the two ports are in alignment. A circumferential rib 75 on the valve element engages in a mating groove in the barrel to keep the parts in appropriate alignment.

Housed within the brush chamber 66 is a brush 76 that consists of a brush back 78 secured to and projecting from a plunger 80 that slides along the brush chamber 66. A pair of lugs 82 project radially from the plunger 80 and engage in grooves 84 extending along the inside of the brush chamber to act as guides for the plunger and the brush. The brush back is equipped with bristles 86 adjacent to an absorbent pad 83 that extends from the plunger to adjacent the free end of the brush.

The end of the barrel remote from the base 54 is equipped with a cover 90 that has a cylindrical wall 92 and an end wall 94 having a relatively large eccentric opening 96 therein. The cover 90 is retained in place on the end of the barrel by circumferential rib 98 on the barrel and the mating circumferential groove 100 on the inside of the cover. A coil spring 104 is located between the base of the brush chamber and the plunger 80 to drive the plunger and the brush along the brush chamber when the cover 90 is rotated to align the eccentric opening 96 with the end of the brush chamber so that the brush can be projected from the end of the barrel. To limit this movement, the grooves 84 end short of the end of the barrel at stops 102. These engage the lugs 82 on the plunger to limit its travel.

In operation of this embodiment, the cap is removed, the valve operator is deflected momentarily to allow liquid dentifrice to run from the reservoir into the brush chamber to be absorbed by the absorbent pad 88 of the brush and then the cover 90 is rotated to allow the brush to project from the end of the barrel under the influence of spring 104. In the open condition illustrated in FIG. 8, the plunger 80 covers the port 74 to prevent any inadvertent discharge of dentifrice. After the brush has been used, it can be pressed back into the brush chamber and the cover 90 rotated once more to hold it in place.

Referring now to FIGS. 9 through 13, there is illustrated a brush 110 that is configured generally to resemble a disposable cigarette lighter in overall appearance and to function generally in the manner of a pocket knife. The brush consists of a generally rectangular container 112 housing a reservoir 114 for liquid dentifrice. A brush chamber 116 extends along one side of the reservoir from a generally cylindrical recess adjacent one end of the container. The recess houses a cylindrical valve chamber 118 with a cylindrical wall 120 and circular end walls 122. Each of the end walls 122 is equipped with a central stud 124 that serves as a pivot for the valve chamber, fitting into an appropriate opening in the side wall of the container 112. A brush back 126 projects tangentially from the cylindrical wall 120 of the valve chamber. It is equipped with bristles 128 surrounding an absorbent pad 130. The absorbent pad extends along the brush pack from adjacent an outlet port 132 in the cylindrical wall 120 of the valve chamber.

Figure 10:
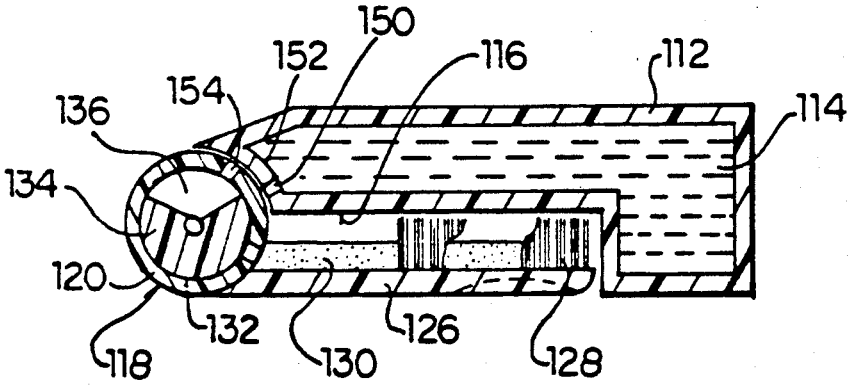
FIG. 10 is a longitudinal cross-section of the embodiment of FIG. 9.
Figure 11:
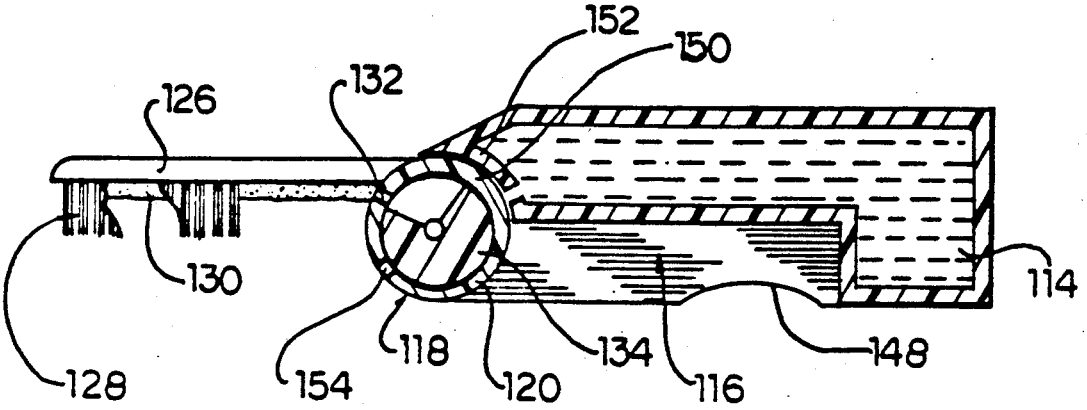
FIG. 11 is a longitudinal cross-section of the embodiment of FIG. 9 in an open condition.
Figure 12:
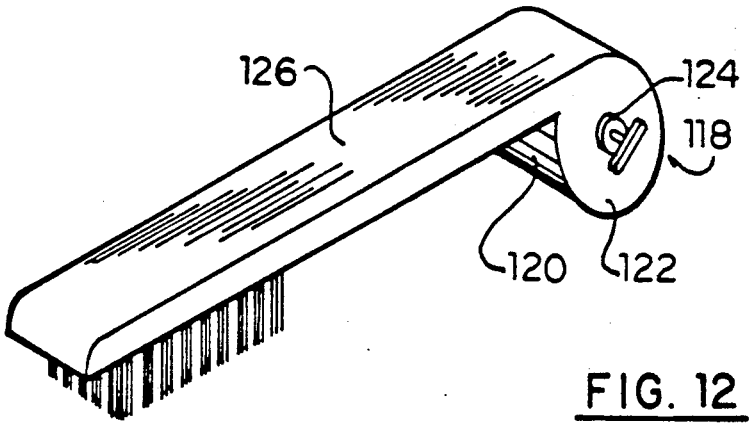
FIG. 12 is a perspective view of the brush valve assembly of the embodiment of FIG. 9.
Figure 13:
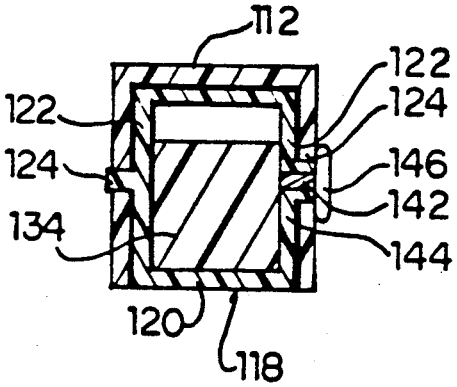
FIG. 13 is a cross-section along line XIII—XIII of FIG. 10.

Housed within the valve chamber 118 is a valving element 134 in the front of a solid cylindrical plug with a segment removed. The missing segment defines a transfer chamber 136. On one side of the valving element, there is a shaft 142 that projects through an axial bore 144 in one end of the valve chamber 118. The bore 144 and the shaft 142 extend completely through the pivot 124 on the end wall and a handle 146 is attached to the end of the shaft 142 outside of the container 112. As is seen most readily in FIGS. 10 and 11, the reservoir has an outlet port 150 in a cylindrical wall 152 thereof that mates with the cylindrical wall 120 of the valve chamber 118. The cylindrical wall 120 in the valve chamber is equipped with an inlet port 154 angularly spaced from the outlet port 132 so that it is out of line with the outlet port 150 when the brush is fully seated in the brush chamber as shown in FIG. 10, but comes into registry with the outlet port 150 once the brush has been withdrawn from the chamber by a few degrees.

To facilitate the withdrawal of the brush from its chamber, the sides of the container 112 have appropriate finger notches 148.

In use, the brush is pivoted out of the brush chamber until the ports 150 and 152 come into registry. This can be signalled to the user by engagement of a detent between the valve chamber 118 and the container 112. The valve element is then placed in the position illustrated in FIG. 10 so that liquid from the reservoir will fill the transfer chamber 136. The brush is then rotated to the extended position illustrated in FIG. 11, thus closing the outlet port 150 from the reservoir. The valving element 134 may then be rotated to the discharge position illustrated in FIG. 11 so that the liquid in the transfer chamber will run out of the outlet port 132 from the valve chamber 118 to be absorbed in the absorbent pad 130 of the brush.

Figure 14:
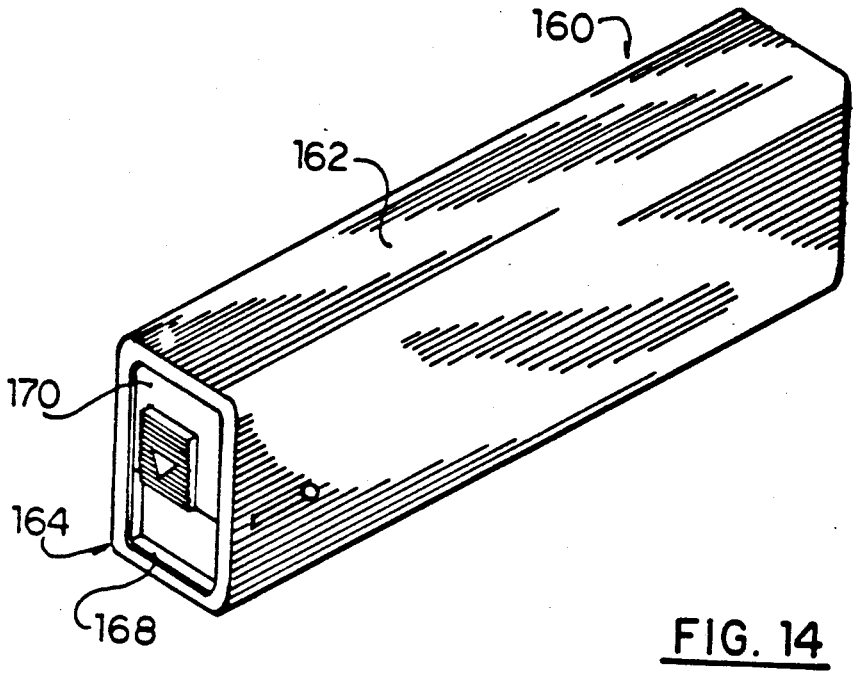
FIG. 14 is a perspective view of another embodiment of the present invention.
Figure 15:
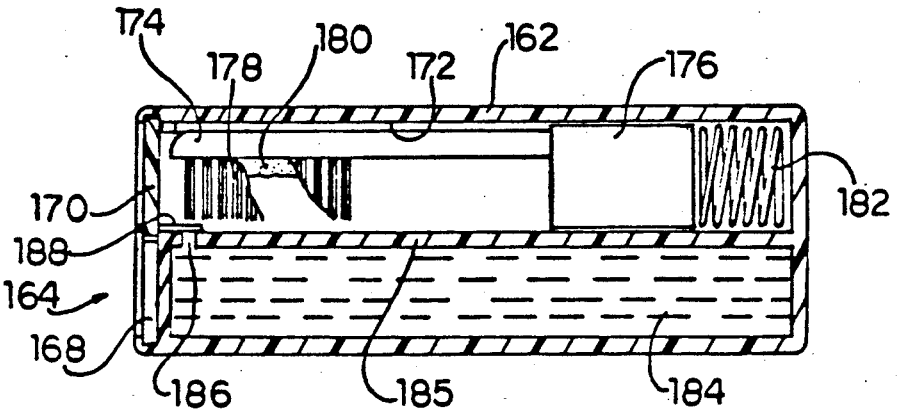
FIG. 15 is a longitudinal cross-section of the embodiment of FIG. 14.
Figure 16:
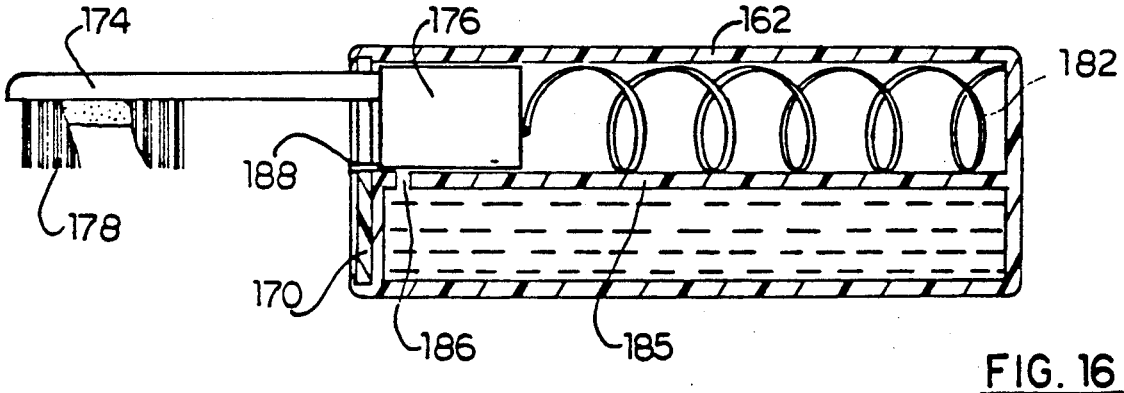
FIG. 16 is a longitudinal cross-section of the embodiment of FIG. 14 with the brush extended.

Turning now to FIGS. 14 through 16, there is illustrated a toothbrush 160 that is housed in a container 162 configured generally as an elongated rectangular prism somewhat like certain cigarette lighters. At one end of the container is a latch mechanism 164. The latch mechanism includes an internal peripheral groove 168 just inside the end of the container and a rectangular cover 170 that slides in the groove between a closed position shown in FIGS. 14 and 15 and an open position shown in FIG. 16. As shown in FIG. 15, the cover normally closes the end of a brush chamber 172 housing a brush consisting of a brush back 174 mounted on a rectangular plunger 176 shaped and sized to slide in the brush chamber 172 without rotation. The brush back 174 is also equipped with bristles 178 and an absorbent pad 180. A coil spring 182 is located in the brush chamber between the plunger 176 and the closed end of the chamber.

Figure 17:
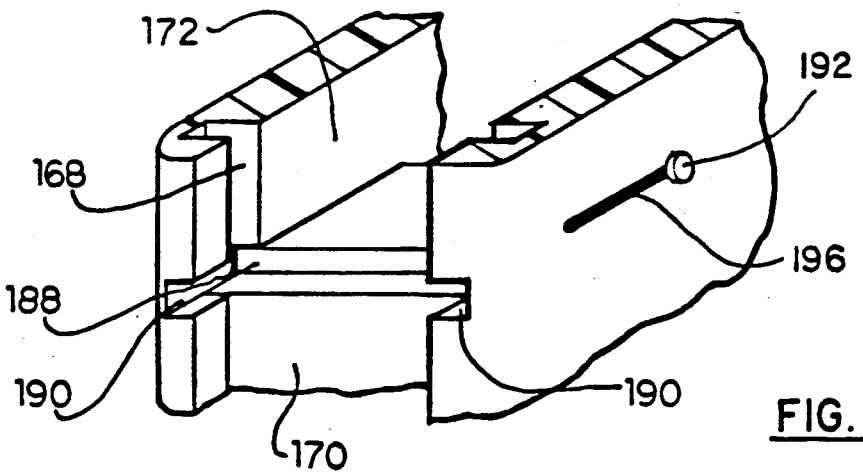
FIG. 17 is a perspective detail of the embodiment of FIG. 14.

A reservoir 184 for liquid dentifrice is separated from the brush chamber by a longitudinal wall 185. Near the cover 170, the wall 185 has a through port 186 normally closed by a valve plate 188. The plate slides in a pair of groove 190 (FIG. 17) in the side walls of the container.

With the cover 170 in the closed condition as illustrated in FIG. 15, the valve slide is retained between the cover and the ends of the grooves so that the valve is kept closed. When the cover 170 is retracted to allow the brush to project from the container, the valve may be moved to the open position illustrated in FIG. 16, through the use of a stud 192 fixed to the valve plate 188 and projecting through an elongated slot 196 in the side wall of the container. In the open position, valve plate 188 extends across groove 168 to keep the cover 170 in its open position. When the brush is fully extended as shown in FIG. 16, the plunger 176 acts as a valve closing the port 186.

While certain embodiments of the invention have been described in the foregoing, it is to be understood that the invention is not limited to those embodiments. The invention is to be limited solely by the scope of the appended claims.

I claim:

1. A toothbrush comprising a container including an elongate tubular reservoir and a cap removably attached to one end of the reservoir, a liquid dentifrice in said reservoir, a brush projecting from said one end of the reservoir and housed within the cap, the brush having a brush back, a liquid absorbent pad on one side of the back, the pad being exposed for engagement with a user's teeth, and bristles projecting from said one side of the back adjacent at least part of the pad, fluid passage means leading from the reservoir to a position adjacent the absorbent pad, and valve means in said fluid passage means, normally closing said fluid passage means and selectively operable to open the fluid passage means to allow liquid dentifrice to run freely from the reservoir into the absorbent pad.

2. A toothbrush according to claim 1 wherein the cap is engageable co-axially with the reservoir.

3. A toothbrush according to claim 1 wherein the container and cap are substantially cylindrical.

* * * * *